US007462087B2

(12) United States Patent
Andreas et al.

(10) Patent No.: US 7,462,087 B2
(45) Date of Patent: Dec. 9, 2008

(54) DISPLAY DEVICE

(75) Inventors: James R. Andreas, Corvallis, OR (US); Lawrence Gianola, Salem, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 241 days.

(21) Appl. No.: 11/264,605

(22) Filed: Oct. 31, 2005

(65) Prior Publication Data

US 2007/0096655 A1 May 3, 2007

(51) Int. Cl.
*H01J 9/00* (2006.01)

(52) U.S. Cl. ..... 445/23; 313/637

(58) Field of Classification Search ..... 313/637, 313/25, 26, 46, 45; 445/23–25
See application file for complete search history.

(56) References Cited

U.S. PATENT DOCUMENTS

| | | | |
|---|---|---|---|
| 4,720,660 | A | 1/1988 | Whelan |
| 5,798,143 | A | 8/1998 | Partridge |
| 5,880,559 | A | 3/1999 | Fox et al. |
| 5,900,982 | A | 5/1999 | Dolgoff et al. |
| 6,481,854 | B1 | 11/2002 | Sugawara et al. |

FOREIGN PATENT DOCUMENTS

| | | | |
|---|---|---|---|
| DE | 19631945 | | 2/1998 |
| JP | 362262357 | A * | 11/1987 |
| JP | 3238748 | | 10/1991 |

* cited by examiner

*Primary Examiner*—Joseph L Williams

(57) ABSTRACT

One embodiment of a projector includes a first enclosure that defines a hermetically sealed interior, an electrode pair positioned within the hermetically sealed interior, and a second enclosure that surrounds the first enclosure, the second enclosure manufactured of diamond.

14 Claims, 2 Drawing Sheets

DISPLAY DEVICE

Display devices, such as projectors, may include a metal vapor discharge lamp including an electrode pair, as the light source. The light source may generate large amounts of light for operation of the display device. However, the light source may also generate large amounts of heat that may be harmful to other components of the display device. The light source may be housed in an enclosure, such as a quartz enclosure, that may break or explode, causing harm to other components of the display device or to a human operator of the device. Accordingly, it may be advantageous to improve the thermal and safety characteristics of the display device.

DETAILED DESCRIPTION OF THE DRAWINGS

Figure 1:
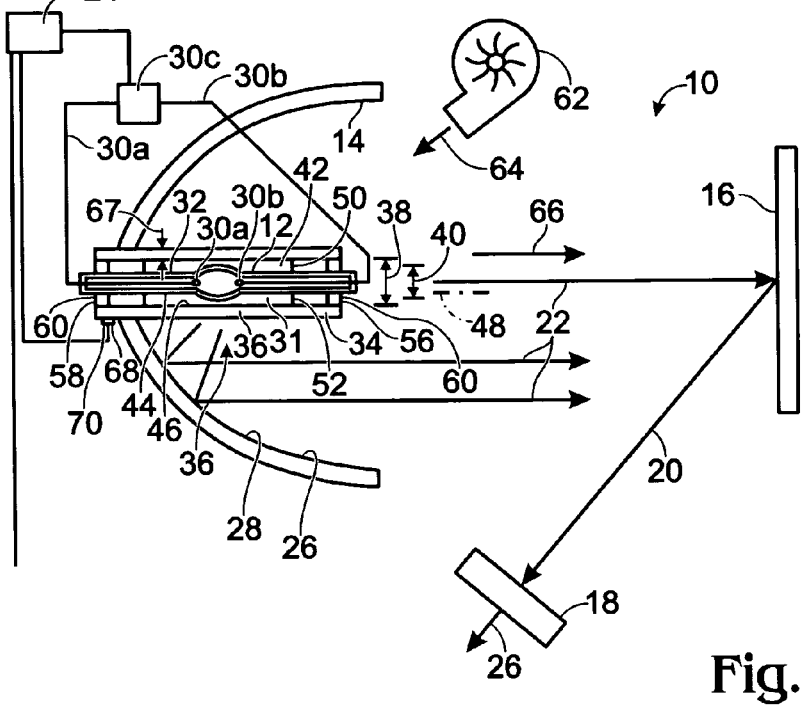
FIG. 1 is a schematic cross-sectional side view of one embodiment of a display device.

FIG. 1 is a schematic cross-sectional side view of one embodiment of a display device 10 including a light source 12, a reflector 14, an image forming device, such as a modulator 16, and an image output device 18. Image output device 18 may be a lens system that may project a light image 20 to a display region (not shown) such as a projection screen (not shown) or the like, or may itself be a projection screen such as a display screen. Image modulator 16 may be any type of device that receives projected light 22 projected from light source 12 and which produces a light image 20 from the light. In the embodiment shown, modulator 16 may be an array including a plurality of movable micromirrors (not shown) that may each be individually controlled by a controller 24. Controller 24 may be a computer that may include software or other operable instructions to control display device 10.

Reflector 14 may receive light 22 projected from light source 12 and thereafter may project the light to modulator 16. In the embodiment shown, reflector 14 includes a reflective surface 26 that defines a cavity 28 wherein light source 12 is positioned within cavity 28. Reflector 14 may define any shape as desired, for example, reflector 14 may define a cavity 28 that is shaped in the form of one of a sphere, an ellipse and a parabola. Reflector 14 may be manufactured of any material that may be suitable for a particular application, such as glass, poly crystalline or metal, and may or may not include a reflective coating formed thereon.

Light source 12 may be any light source that operates to produce projected light beam 22 for imaging. In the embodiment shown, light source 12, which may be referred to as a burner, is a metal vapor discharge lamp including an electrode pair 30 positioned within a first enclosure 32. Light source 12 may be an ultra high pressure (UHP) mercury arc lamp but in other embodiments may comprise any type of technology as desired.

First enclosure 32 may completely seal electrode pair 30 therein, wherein first enclosure 32 may define a hermetic seal of electrode pair 30 so as to seal a discharge gas 31 within the first enclosure. First enclosure 32 may be manufactured of a transparent material, such as a quartz (fused silica), that may normally withstand the high temperatures generated by electrode pair 30. Electrode pair 30 may include terminals 30*a* and 30*b* which extend through and outwardly of first enclosure 32, without compromising the hermetic seal of the enclosure. Terminals 30*a* and 30*b* may be connected to a power source 30*c*, which may be controlled by controller 24, for powering the electrodes to generate light beam 22. Any discharge gas 31 may be utilized, such as mercury, xenon, or the like.

At extreme temperatures or during prolonged use of device 10, the heat generated by electrode pair 30 and discharge gas 31 may cause breakage of first enclosure 32, such as an explosion during a catastrophic breakage of first enclosure 32. Such breakage of first enclosure 32 may cause harm to the other components of device 10, such as damage to reflector 14 or modulator 16, if the first enclosure is not physically shielded from the other components. Even in cases where first enclosure 32 does not explode or otherwise break, the heat generated by electrode pair 30 and discharge gas 31, without removal of such heat, may cause harm to other components of device 10, such as melting or deformation of reflector 14.

Light source 12, in the embodiments shown, includes a second enclosure 34 that encloses first enclosure 32 therein. In the embodiment shown in FIG. 1, second enclosure 34 may be a diamond tube 36 that completely surrounds first enclosure 32 therein. Second enclosure 34 may be formed by any means but in the embodiment shown is a grown/deposited diamond tube 36. Tube 36 may be formed by any formation method. One formation method is described with reference to FIG. 4. Tube 36 may have an innermost dimension, such as an inner diameter 38, that may be larger than an outermost outer dimension 40 of first enclosure 32 such that second enclosure 34 forms a fluid cooling channel or space 42 between an outer surface 44 of first enclosure 32 and an inner surface 46 of second enclosure 34. Space 42 may be filled with any cooling fluid as desired, and in one embodiment may be a cooling gas including at least one of Helium, Oxygen and/or Nitrogen.

Use of diamond to form second enclosure 34 has many benefits because diamond has the following properties: an extreme mechanical hardness, on the order of approximately 90 gigapascals (GPa); a bulk modulus of approximately 1.2×10E12 N/m$^2$; a low compressibility of approximately 8.3×10E−13 m$^2$/N; a high thermal conductivity at room temperature of approximately 2×10E3 W/mK; a low thermal expansion coefficient at room temperature of approximately 0.8×10E−6 K; a broad optical transparency from the deep ultraviolet (UV) to the far infrared (IR) region of the electromagnetic spectrum; and a good electrical insulation quality having a resistivity of approximately 1×10E16 cm. Diamond can be doped to change its resistivity over the range of approximately 10 to 1×10E6 cm, thereby becoming a semiconductor with a wide band gap of approximately 5.4 electron volts (eV). Diamond is resistant to chemical corrosion, including hot acids, bases and other chemicals, and is biologically compatible. Diamond also exhibits a low or "negative" electron affinity, i.e., it emits electrons from its surface with very little applied voltage.

Figure 1A:
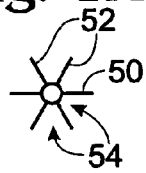
FIG. 1A is a detailed front view of one embodiment of a spacer used in one embodiment of a display device.

Referring to FIGS. 1 and 1A, first enclosure 32 may be positioned centrally along a central axis 48 of second enclosure 34 by the use of positioning devices, such as spacers 50. Spacers 50 may include a "spider" or spoke type design including arms 52 (only two arms of which are shown on each of spacers 50 in FIG. 1) that extend between first enclosure 32 and second enclosure 34. In the embodiment shown, spacers 50 may be manufactured of a heat resistance material and may include air passages (not shown in this view) between arms 52 to allow air to circulate within space 42. In other words, spacers 50 may hold first enclosure 32 within the center of second enclosure 34 without substantially impeding airflow through the second enclosure.

Still referring to FIG. 1, second enclosure 34 may comprise a tube 36 formed with a first open end 56 and a second open end 58. Each of the open ends may be sealed with a cap 60 to hermetically seal first enclosure 32 therein. In another embodiment, caps 60 may function as spacers 50 such that spider type spacers 50 are not utilized and such that caps 60 position first enclosure 32 centrally within second enclosure 34. In other embodiments, spacers 50 may position first enclosure 32 in a position other than centrally within second enclosure 34.

In this embodiment, device 10 may further include a cooling device 62 such as a fan that may force a cooling fluid 64, such as air, over second enclosure 34 to remove heat from within device 10 that is produced by electrode pair 30 and gas 31. Cooling device 62 may be positioned outwardly of a light projection path 66 of device 10 such that the cooling device does not reduce the image quality of device 10.

Second enclosure 34 is positioned with central axis 48 positioned parallel to projection axis 66 of reflector 14. This embodiment may be referred to as an axial configuration of second enclosure 34 within reflector 14. In other embodiments, second enclosure 34 may be oriented in any position, such as in a transverse position wherein central axis 48 of second enclosure 34 is positioned perpendicular to projection axis 66 of reflector 14 (see FIG. 2).

Still referring to FIG. 1, tube 36 of diamond material may have a thickness 67 sufficient to provide a thermal barrier, a thermal measurement surface, and/or a safety barrier around first enclosure 32. Thickness 68 may be in a range of approximately 0.10 millimeters (mm) to 3.5 mm. Second enclosure 34 may function as a thermal barrier by reducing the heat conducted to other components of device 10, such as to reflector 14. Accordingly, reflector 14 may be manufactured in a reduced size or strength as compared with prior art devices because the reflector 14 of the present system need not be designed to experience the heat load of prior art reflectors or to survive an explosion of first enclosure 32.

Second enclosure 34 may function as a measurement surface because the diamond tube may provide improved thermal conduction which may provide improved thermal feedback on the burner temperature, i.e., the temperature of the first enclosure, to controller 24. This thermal feedback information may be gathered by a thermal sensor 68 which may be adhered to an exterior surface of second enclosure 34 by an adhesive 70, such as thermal epoxy. Thermal sensor 68 may be positioned outside cavity 28 of reflector 14 such that a temperature measured by thermal sensor 68 is conducted along second enclosure 34 and outwardly from reflector 14. The temperature measurements of second enclosure 34 gathered by thermal sensor 68 may allow improved thermal regulation of the display device, which may allow improved regulation of the fan speed of cooling device 62, thereby providing improved regulation of the surface temperature of first enclosure 32, over prior art display device designs.

In prior art arc lamps, for example, an electrode pair may heat the outer surface of their enclosure to a temperature of approximately 1000 degrees Celsius (° C.). The hottest part of the reflector may have a temperature in a range of approximately 300 to 350° C. The coldest part of the reflector may have a temperature in a range of approximately 180 to 200° C. Accordingly, inside the closed arc lamp of prior art designs, an intensive air recirculation may take place. Additionally, an air plume around the outer surface of the lamp enclosure may be unstable, especially around the reflector neck, where the temperature gradient may be the largest. Use of a second enclosure 32 of the present design may reduce this temperature gradient and provide a reliable temperature measurement for temperature regulation of the lamp.

Second enclosure 34 may also function as a safety barrier around first enclosure 32 by withstanding physical impact of shards of first enclosure 32, and by containing chemicals within the system, such as containing mercury gas from inside first enclosure 32, in the event that first enclosure 32 ruptures. The strength of diamond fabricated second enclosure 34 may reduce the need for other safety barrier or capture devices within display device 10, thereby reducing the cost, size, and/or weight of display device 10 when compared to prior art devices.

Figure 2:
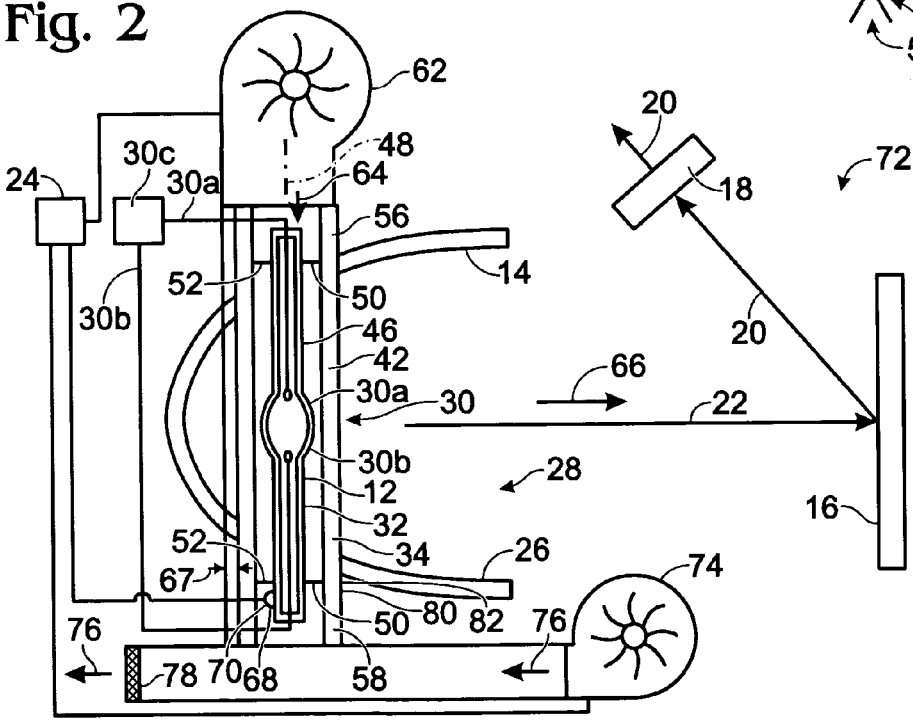
FIG. 2 is a schematic cross-sectional side view of another embodiment of a display device.

FIG. 2 is a schematic cross-sectional side view of another embodiment of a display device 72. Device 72 has many of the same components of display device 10 shown in FIG. 1. However, device 72 in FIG. 2 has a transverse orientation of second enclosure 34 such that central axis 48 of second enclosure 34 is positioned perpendicular to projection path 66. Second enclosure 34, in this embodiment, includes open ends 56 and 58 without the use of caps 60. Accordingly, cooling fluid channel or space 42 is open to cooling device 62 such that cooling fluid 64 passes through space 42, through air passages 54 (FIG. 1A) between arms 52 of spacers 50, and directly over first enclosure 32. The cooling fluid may enter second enclosure 34 at first end 56 and exit second enclosure 34 at second end 58.

Cooling fluid 64 may then be removed from the system by a second cooling device 74 that forces a second cooling fluid 76 by second end 58 of second enclosure 34 and out a grating 78 and away from reflector 14. In other embodiments, a second cooling device may not be used, or another type of cooling method may be utilized. In this embodiment, spacers 50 may be positioned outwardly of reflector 14 and light projection path 66 of device 72 such that the spacers do not reduce the image quality of device 72. In this embodiment, second enclosure 34 may comprise a transparent tube 80, such as quartz, having a diamond coating 82 formed thereon. The diamond coating 82 may be formed as described with reference to FIG. 4. Diamond coating 82 may allow second enclosure 34 to provide a thermal barrier, a thermal measurement surface, and/or a safety barrier around first enclosure 32, as described with reference to FIG. 1.

Figure 3:
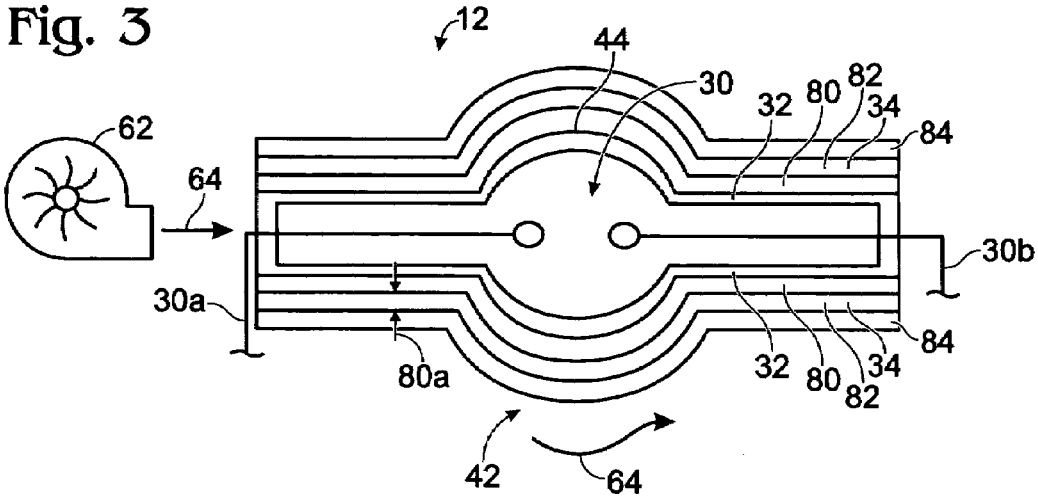
FIG. 3 is a schematic cross-sectional side view of another embodiment of a light source of a display device.

FIG. 3 is a schematic cross-sectional side view of another embodiment of a light source 12 of a display device. This embodiment includes first enclosure 32 including an outer surface 44. In this embodiment, first enclosure 32 may be referred to as a burner and outer surface 44 of first enclosure 32 may be referred to as the bare burner stem enclosure. First enclosure 32 may be manufactured of a transparent material such as high temperature quartz.

An adhesion promotion coating 80 may be formed on outer surface 44 of first enclosure 32. Adhesion promotion coating 80 may be formed of silane or the like, which may promote the adhesion of another coating, such as a diamond coating, on the outer surface 44 of first enclosure 32. In another embodiment, coating 80 may be a layer of an index matching material that may be selected to increase transmittance through the burner assembly of predetermined wavelengths of light of interest.

A second enclosure 34 may then be formed on adhesion promotion coating 80 as another layer 82. Layer 82 may be an optical coating of grown/deposited diamond material, such as an alpha carbon coating, which may have a thickness 80*a* of approximately 50 to 200 nm. Diamond coating 82 may be formed on layer 80 as described with reference to FIG. 4. Accordingly, in this embodiment, second enclosure 34 of the device is coated directly on an exterior surface of light source 12 such that there is no cooling space or channel between first enclosure 32 and second enclosure 34. In this embodiment, cooling space 42 is positioned exterior to second enclosure 34 such that a cooling device 62 may direct a cooling fluid 64 over an exterior surface of second enclosure 34.

In this embodiment, an ultra violet and/or infrared (UV/IR) filtering coating 84 may then be formed on diamond coating 82. The infrared coating 84 may allow the display device to utilize regenerative heating to reduce the operational requirements and the initial strike requirements of the light source 12. The UV/IR coating may also eliminate the use of a separate UV/IR filter positioned downstream within projection path 66 (see FIG. 1) of the device. In other embodiments, other layers and other arrangements of layers may be positioned on first enclosure 32 wherein second enclosure 34 may be one of these layers formed on first enclosure 32.

Figure 4:
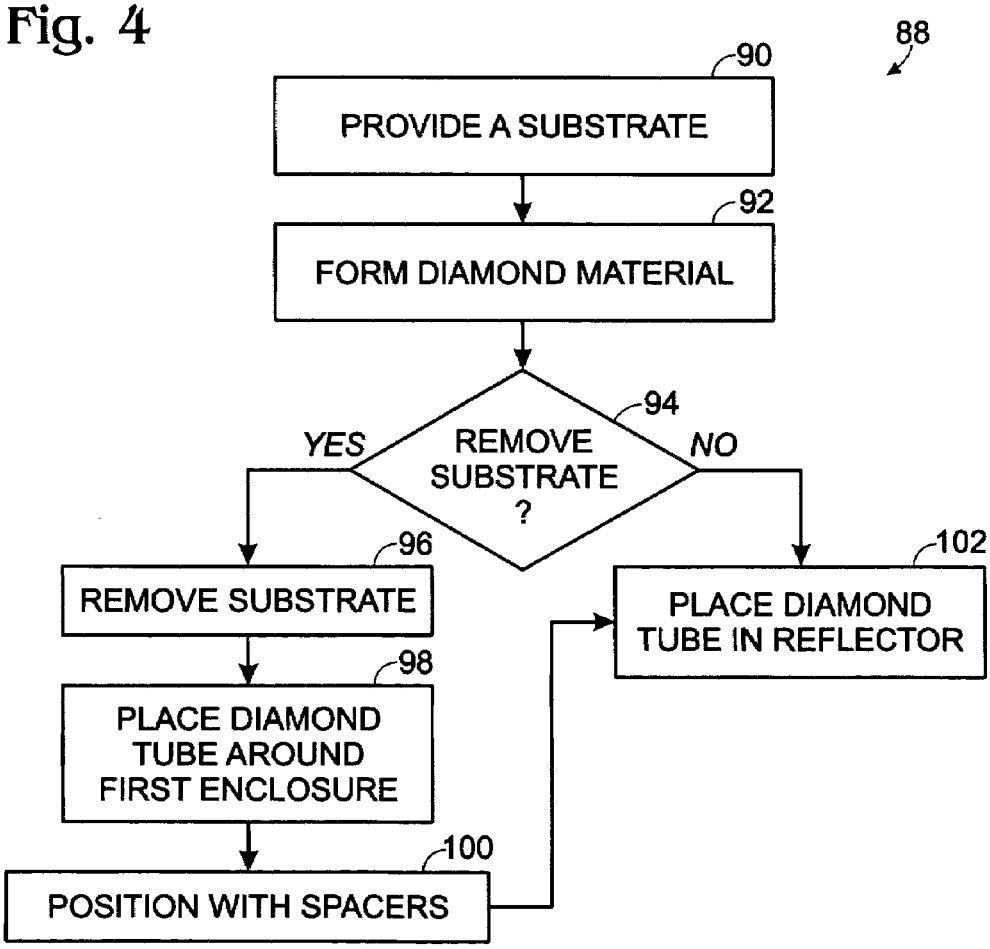
FIG. 4 is a flowchart showing one embodiment of a method of manufacturing a display device.

FIG. 4 is a flowchart showing one embodiment of a method 88 of manufacturing a display device. In this embodiment, in step 90 a substrate is provided. The substrate may be a metal wire, a non-metallic fiber or a first enclosure 32 including electrode pair 30 therein. Examples of substrate materials include tungsten, molybdenum, copper or silicon, typically in the form of a wire, having a diamond nucleation site formed into a helix. The helix is then placed or moved through a CVD chamber for deposition of the diamond on the helix. A suitable pitch and diameter of the helix results in deposition of the diamond on the helix until such time as the growth surfaces of the diamond fuse to form a hollow diamond tube. In step 92 the diamond material is then formed on the substrate by a growth or deposition process. In one embodiment the formation method may include chemical vapor deposition (CVD) techniques. This diamond formation step 92 may include, as one example, providing a tungsten fibre, a formation gas including hydrocarbons and an excess of hydrogen, a temperature in a range of approximately 700° C. or more, and a pressure in a range of approximately a few tens of Torrs, to yield a growth rate of approximately 1×10e−6 to 4×10e−6. Further details of one embodiment of a formation technique may be found in U.S. Pat. No. 5,798,143, entitled CVD Process for Making a Hollow Diamond Tube, issued to Partridge on Aug. 25, 1998, which is hereby incorporated in its entirety by reference herein. The process make take place in a deposition chamber, in a tank, or any other container as applicable for a particular formation method.

In step 94, an operator may determine if the substrate should be removed from the interior of the diamond tube that is formed. If yes, in step 96 the substrate may be removed from inside the formed diamond tube by melting, chemical etching or the like. In step 98 the hollow diamond tube may then be placed around first enclosure 32. In step 100 spacers 50 (see FIG. 1) maybe used to position the first enclosure 32 (see FIG. 1) within second diamond enclosure 34 (see FIG. 1). Spacers 50 may be in the form of end caps in the embodiment wherein second enclosure 34 is sealed, and spacers 50 may be in the form of spider type spacers (see FIG. 1A) in the embodiment wherein second enclosure 34 remains open at its ends 56 and 58.

If the answer to step 94 is no, the diamond coating is left on the substrate and the process may proceed to step 102.

In step 102 second enclosure 34, with first enclosure 32 positioned therein, is placed within a reflector 14, positioned adjacent modulator 16 and connected to controller 24 (see FIG. 1). The display device 10 is then ready for operation. Of course, other method steps and sequences of method steps may be utilized in the present invention for formation of a display device utilizing a diamond enclosure.

The foregoing description of embodiments of the invention have been presented for purposes of illustration and description. It is not intended to be exhaustive or to limit the invention to the precise form disclosed, and modifications and variation are possible in light of the above teachings or may be acquired from practice of the invention. The embodiments were chosen and described in order to explain the principles of the invention and its practical application to enable one skilled in the art to utilize the invention in various embodiments and with various modification as are suited to the particular use contemplated. It is intended that the scope of the invention be defined by the claims appended hereto and their equivalents.

We claim:

1. A method of manufacturing a lamp, comprising:

enclosing an electrode pair within a first enclosure formed of quartz;

enclosing said first enclosure within a second enclosure manufactured of diamond.

2. The method of claim 1 wherein said enclosing said first enclosure comprises forming a diamond coating on an exterior surface of said first enclosure.

3. A method of manufacturing a lamp, comprising:

enclosing an electrode pair within a first enclosure;

enclosing said first enclosure within a second enclosure manufactured of diamond, wherein said enclosing said first enclosure comprises forming a diamond coating on an exterior surface of said first enclosure; and wherein said exterior surface of said first enclosure is coated with at least one of an adhesion promotion layer and an index matching layer prior to formation of said diamond coating thereon.

4. A method of manufacturing a lamp, comprising:

enclosing an electrode pair within a first enclosure;

enclosing said first enclosure within a second enclosure manufactured of diamond; and wherein said enclosing said first enclosure comprises forming a diamond tube and thereafter placing said first enclosure within said diamond tube.

5. The method of claim 4 further comprising sealing said diamond tube with said first enclosure positioned therein.

6. The method of claim 4 wherein said diamond tube includes first and second openings, said method further comprising connecting a cooling device to one of said first and second openings and forcing a cooling fluid through said diamond tube and around said first enclosure by said cooling device to cool said first enclosure.

7. A method of manufacturing a lamp, comprising:

enclosing an electrode pair within a first enclosure; and enclosing said first enclosure within a second enclosure manufactured of diamond such that that second enclosure is out of direct contact with said first enclosure.

8. The method of claim 7 wherein said first enclosure is separated from said second enclosure by a coolant filled gap.

9. The method of claim 7 wherein said first enclosure is separated from said second enclosure by at least one of an adhesion promotion layer and an index matching layer.

10. The method of claim 8 wherein said coolant filled gap is filled with a cooling gas.

11. A method of manufacturing a lamp, comprising:

enclosing an electrode pair within a first enclosure; and enclosing said first enclosure within a second enclosure manufactured of diamond such that that second enclosure is spaced from said first enclosure.

12. The method of claim 11 wherein said second enclosure is spaced from said first enclosure by a gas filled gap.

13. The method of claim 12 wherein said gas filled gap is filled with a cooling gas.

14. The method of claim 11 wherein said second enclosure is spaced from said first enclosure by at least one of an adhesion promotion layer and an index matching layer.

* * * * *